United States Patent [19]

Larson et al.

[11] Patent Number: 5,077,171

[45] Date of Patent: Dec. 31, 1991

[54] CARBOHYDRATE PRODUCTS OF PHOTOSYNTHESIS AS CHARGING ADJUVANT FOR POSITIVE LIQUID ELECTROSTATIC DEVELOPERS

[75] Inventors: James R. Larson, West Chester; Arnold R. Lee, Philadelphia, both of Pa.

[73] Assignee: DX Imaging, Lionville, Pa.

[21] Appl. No.: 626,884

[22] Filed: Dec. 13, 1990

[51] Int. Cl.[5] ..... G03G 9/12

[52] U.S. Cl. ..... 430/115; 106/25; 106/32

[58] Field of Search ..... 430/115; 106/25, 32

[56] References Cited

U.S. PATENT DOCUMENTS 4,874,683 10/1989 Shirai et al. ..... 430/115 X 4,965,159 10/1990 Kohno ..... 430/138 X

*Primary Examiner*—David Welsh

[57] ABSTRACT

An electrostatic liquid developer having positive charging characteristics consisting essentially of:

(A) a non-polar liquid having a Kauri-butanol value of less than 30, present in a major amount, (B) thermoplastic resin particles having an average by area particle size of less than 10 μm, (C) a nonpolar liquid soluble ionic or zwitterionic charge director compound, and (D) a carbohydrate product of photosynthesis comprised of at least one saccharose present in (A) and/or dispersed in (B).

The liquid developer is useful in copying, color proofing, digital color proofing, making lithographic printing plates, and resists.

28 Claims, No Drawings

CARBOHYDRATE PRODUCTS OF PHOTOSYNTHESIS AS CHARGING ADJUVANT FOR POSITIVE LIQUID ELECTROSTATIC DEVELOPERS

TECHNICAL FIELD

This invention relates to electrostatic liquid developers. More particularly this invention relates to a positive-charged liquid electrostatic developer containing a carbohydrate product of photosynthesis comprised of at least one saccharose as a charging adjuvant.

BACKGROUND OF THE INVENTION

It is known that a latent electrostatic image can be developed with toner particles dispersed in an insulating nonpolar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid developers comprise a thermoplastic resin and nonpolar liquid. Generally a suitable colorant is present such as a dye or pigment. The colored toner particles are dispersed in the nonpolar liquid which generally has a high-volume resistivity in excess of $10^9$ ohm centimeters, a low dielectric constant below 3.0, and a high vapor pressure. The toner particles are less than 30 $\mu$m average size as determined using the Malvern Particle Sizer described below. After the latent electrostatic image has been formed, the image is developed by the colored toner particles dispersed in said nonpolar liquid and the image may subsequently be transferred to a carrier sheet.

Since the formation of proper images depends on the differences of the charge between the liquid developer and the latent electrostatic image to be developed, it has been found desirable to add a charge director compound and preferably adjuvants, e.g., polyhydroxy compounds, polybutylene succinimide, an aromatic hydrocarbon, etc., to the liquid developer comprising the thermoplastic resin, nonpolar liquid, and preferably a colorant. Such liquid developers provide images of good resolution, but it has been found that charging and image quality are particularly pigment dependent. Some formulations, suffer from poor image quality manifested by low resolution, poor solid area coverage (density), and/or image squash. Some formulations result in wrong sign (negative) developers. In order to overcome such problems much research effort has been expended to develop new type charge directors and/or charging adjuvants for electrostatic liquid developers.

It has been found that the above disadvantages can be overcome and improved positive-charged developers prepared containing a nonpolar liquid, charge director compound, a thermoplastic resin, and preferably a colorant, and carbohydrate product of photosynthesis comprised of at least one saccharose as described below. The electrostatic liquid developer when used to develop an electrostatic image results in improved image quality, reduced squash, improved solid area coverage independent of the pigment and charge director compound present.

SUMMARY OF THE INVENTION

In accordance with this invention there is provided an electrostatic liquid developer having positive charging characteristics consisting essentially of:

(A) a non-polar liquid having a Kauri-butanol value of less than 30, present in a major amount, (B) thermoplastic resin particles having an average by area particle size of less than 10 $\mu$m, (C) a nonpolar liquid soluble ionic or zwitterionic charge director compound, and (D) a carbohydrate product of photosynthesis comprised of at least one saccharose.

Throughout the specification the below-listed terms have the following meanings

In the claims appended hereto "consisting essentially of" means the composition of the electrostatic liquid developer does not exclude unspecified components which do not prevent the advantages of the developer from being realized. For example, in addition to the primary components, there can be present additional components, such as a colorant, fine particle size oxides, adjuvant, e.g., polyhydroxy compound, polybutylene succinimide, aromatic hydrocarbon, etc.

Conductivity is the conductivity of the developer measured in pmhos/cm at 5 hertz and 5 volts.

The nonpolar liquids (A) are, preferably, branched-chain aliphatic hydrocarbons and more particularly, Isopar®-G, Isopar®-H, Isopar®-K, Isopar®-L, Isopar®-M and Isopar®-V. These hydrocarbon liquids are narrow cuts of iso-paraffinic hydrocarbon fractions with extremely high levels of purity. For example, the boiling range of Isopar®-G is between 157° C. and 176° C., Isopar®-H between 176° C. and 191° C., Isopar®-K between 177° C. and 197° C., Isopar®-L between 188° C. and 206° C. and Isopar®-M between 207° C. and 254° C. and Isopar®-V between 254.4° C. and 329.4° C. Isopar®-L has a mid-boiling point of approximately 194° C. Isopar®-M has a flash point of 80° C. and an auto-ignition temperature of 338° C. Stringent manufacturing specifications, such as sulfur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar®12, Norpar®13 and Norpar®15, Exxon Corporation, may be used. These hydrocarbon liquids have the following flash points and auto-ignition temperatures:

| | Flash Point (°C.) | Auto-Ignition Temp (°C.) |
|---|---|---|
| Norpar®12 | 69 | 204 |
| Norpar®13 | 93 | 210 |
| Norpar®15 | 118 | 210 |

All of the nonpolar liquids have an electrical volume resistivity in excess of $10^9$ ohm centimeters and a dielectric constant below 3.0. The vapor pressures at 25° C. are less than 10 Torr. Isopar®-G has a flash point, determined by the tag closed cup method, of 40° C., Isopar®-H has a flash point of 53° C. determined by ASTM D 56. Isopar®-L and Isopar®-M have flash points of 61° C., and 80° C., respectively, determined by the same method. While these are the preferred nonpolar liquids, the essential characteristics of all suitable nonpolar liquids are the electrical volume resistivity and the dielectric constant. In addition, a feature of the nonpolar liquids is a low Kauri-butanol value less than 30, preferably in the vicinity of 27 or 28, determined by ASTM D 1133. The ratio of thermoplastic resin to nonpolar liquid is such that the combination of ingredients becomes fluid at the working temperature. The nonpolar liquid is present in an amount of 85 to 99.9% by weight, preferably 97 to 99.5% by weight, based on the total weight of liquid developer. The total weight of solids in the liquid developer is 0.1 to 15%, preferably 0.5 to 3.0% by weight. The total weight of solids in the liquid developer is solely based on the resin, including any components dispersed therein, and any pigment component present.

Useful thermoplastic resins or polymers (B) include: ethylene vinyl acetate (EVA) copolymers (Elvax® resins, E. I. du Pont de Nemours and Company, Wilmington, Del.), copolymers of ethylene and an $\alpha,\beta$-ethylenically unsaturated acid selected from the group consisting of acrylic acid and methacrylic acid, copolymers of ethylene (80 to 99.9%)/acrylic or methacrylic acid (20 to 0%)/alkyl ($C_1$ to $C_5$) ester of methacrylic or acrylic acid (0 to 20%), polyethylene, polystyrene, isotactic polypropylene (crystalline), ethylene ethyl acrylate series sold under the trademark Bakelite® DPD 6169, DPDA 6182 Natural and DTDA 9169 Natural by Union Carbide Corp., Stamford, Conn.; ethylene vinyl acetate resins, e.g., DQDA 6479 Natural and DQDA 6832 Natural 7 also sold by Union Carbide Corp.; Surlyn® ionomer resin by E. I. du Pont de Nemours and Company, Wilmington, Del., etc., or blends thereof, polyesters, polyvinyl toluene, polyamides, styrene/-butadiene copolymers and epoxy resins. The synthesis of copolymers of ethylene and an $\alpha,\beta$-ethylenically unsaturated acid of either acrylic acid or methacrylic acid is described in Rees U.S. Pat. No. 3,264,272, the disclosure of which is incorporated herein by reference. For the purposes of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. A preferred copolymer is ethylene (90% by weight)/methacrylic acid (10% by weight). The acid numbers of the copolymers range from 1 to 120, preferably 54 to 90. acid no. is milligrams potassium hydroxide required to neutralize 1 gram of polymer. The melt index (g/10 min) of 100 to 500 is determined by ASTM D 1238, Procedure A. Preferred copolymers of this type have an acid number of 66 and 60 and a melt index of 100 and 500 determined at 190° C., respectively.

Other resins include acrylic resins, such as a copolymer of acrylic or methacrylic acid (optional but preferred) and at least one alkyl ester of acrylic or methacrylic acid wherein alkyl is 1–20 carbon atoms, e.g., methyl acrylate (50–90%)/methacrylic acid (0–20%-)/ethylhexyl methacrylate (10–50%) (Preferred is methylmethacrylate (67%)/methacrylic acid (3%)/ethylhexyl acrylate (30%)); and other acrylic resins including Elvacite® acrylic resins, E. I. du Pont de Nemours and Company, Wilmington, Del. or blends of resins, and modified resins disclosed in El-Sayed et al. U.S. Pat. No. 4,798,778, the disclosure of which is incorporated herein.

In addition, the resins have the following preferred characteristics:

1. Be able to disperse the colorant, e.g., pigment, etc.

2. Be substantially insoluble in the dispersant liquid at temperatures below 40° C., so that the resin will not dissolve or solvate in storage, 3. Be able to solvate at temperatures above 50° C., 4. Be able to be ground to form particles between 0.1 μm and 5 μm, in diameter (preferred size), e.g., determined by Horiba CAPA-500 centrifugal particle analyzer; and between 1 μm and 15 μm in diameter, e.g., determined by Malvern 3600E described below, 5. Be able to form a particle (average by area) of less than 10 μm, e.g., determined by Horiba CAPA-500 centrifugal automatic particle analyzer, manufactured by Horiba Instruments, Inc., Irvine, Calif.: solvent viscosity of 1.24 cps, solvent density of 0.76 g/cc, sample density of 1.32 using a centrifugal rotation of 1,000 rpm, a particle size range of 0.01 to less than 10 μm, and a particle size cut of 1.0 μm, and about 30 μm average particle size, e.g., determined by Malvern 3600E Particle Sizer, and 6. Be able to fuse at temperatures in excess of 70° C. By solvation in 3. above, the resins forming the toner particles will become swollen, or gelatinous, or softened.

The Malvern 3600E Particle Sizer manufactured by Malvern, Southborough, Mass. uses laser diffraction light scattering of stirred samples to determine average particle sizes. Since the Horiba and Malvern instruments use different techniques to measure average particle size the readings differ. The following correlation of the average size of toner particles in micrometers (μm) for the two instruments is:

| Value Determined By Malvern 3600E Particle Sizer | Expected Range For Horiba CAPA-500 |
|---|---|
| 30 | 9.9 + 3.4 |
| 20 | 6.4 + 1.9 |
| 15 | 4.6 + 1.3 |
| 10 | 2.8 + 0.8 |
| 5 | 1.0 + 0.5 |
| 3 | 0.2 + 0.6 |

This correlation is obtained by statistical analysis of average particle sizes for 67 liquid electrostatic developer samples (not of this invention) obtained on both instruments. The expected range of Horiba values was determined using a linear regression at a confidence level of 95%. In the claims appended to this specification the particle size values are as measured using the Horiba instrument.

Suitable nonpolar liquid soluble ionic or zwitterionic charge director compounds (C) which are used in an amount of 0.25 to 1,500 mg/g, preferably 2.5 to 400 mg/g developer solids, include: anionic glyceride such as Emphos® D70-30C and Emphos® F27-85, two commercial products sold by Witco Corp., New York, N.Y.; which are sodium salts of phosphated mono- and diglycerides with unsaturated and saturated acid substituents, respectively, lecithin, Basic Barium Petronate®, Neutral Barium Petronate®, Calcium Petronate®, Neutral Calcium Petronate®, oil-soluble petroleum sulfonates, Witco Corp., New York, N.Y.; and metallic soaps such as aluminum tristearate, aluminum distearate; barium, calcium, lead and zinc stearates;

cobalt, manganese, lead and zinc linoleates, aluminum, calcium and cobalt octoates; calcium and cobalt oleates; zinc palmitate; calcium, cobalt, manganese, iron, lead and zinc naphthenates; calcium, cobalt, manganese, lead and zinc resinates, etc.

Carbohydrate products of photosynthesis comprised of at least one saccharose (D) which may be present in the nonpolar liquid and/or dispersed in the resin include: D-glucose, D-ribose, D-fructose, D-allose, D-altrose, D-mannose, D-sorbose, D-gulose, D-idose, D-galactose, D-talose, D-psicose, D-tagatose, L-gulose, L-sorbose, and L-glucose.

Preferred carbohydrate products of photosynthesis comprised of at least one saccharose include D-glucose, D-ribose, D-fructose, L-sorbose and D-galactose.

The carbohydrate products of photosynthesis may be present in the amount of 1 to 25%, preferably 5 to 15% based on the total weight of developer solids.

As indicated above, additional components that can be present in the electrostatic liquid developer are colorants, such as pigments or dyes and combinations thereof, which are preferably present to render the latent image visible, though this need not be done in some applications. The colorant, e.g., a pigment, may be present in the amount of up to about 60 percent by weight based on the total weight of developer solids, preferably 0.01 to 30% by weight based on the total weight of developer solids. The amount of colorant may vary depending on the use of the developer. Examples of pigments include:

Pigment List

| Pigment Brand Name | Manufacturer | Color Index Pigment |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| Hansa Yellow RA | Hoechst | Yellow 73 |
| Hansa Brilliant Yellow 5GX-02 | Hoechst | Yellow 74 |
| Dalamar ® Yellow YT-858-D | Heubach | Yellow 74 |
| Hansa Yellow X | Hoechst | Yellow 75 |
| Novoperm ® Yellow HR | Hoechst | Yellow 83 |
| Chromophtal ® Yellow 3G | Ciba-Geigy | Yellow 93 |
| Chromophtal ® Yellow GR | Ciba-Geigy | Yellow 95 |
| Novoperm ® Yellow FGL | Hoechst | Yellow 97 |
| Hansa Brilliant Yellow 10GX | Hoechst | Yellow 98 |
| Lumogen ® Light Yellow | BASF | Yellow 110 |
| Permanent Yellow G3R-01 | Hoechst | Yellow 114 |
| Chromophtal ® Yellow 8G | Ciba-Geigy | Yellow 128 |
| Irgazin ® Yellow 5GT | Ciba-Geigy | Yellow 129 |
| Hostaperm ® Yellow H4G | Hoechst | Yellow 151 |
| Hostaperm ® Yellow H3G | Hoechst | Yellow 154 |
| L74-1357 Yellow | Sun Chem. | Yellow 14 |
| L75-1331 Yellow | Sun Chem. | Yellow 17 |
| L75-2337 Yellow | Sun Chem. | Yellow 83 |
| Hostaperm ® Orange GR | Hoechst | Orange 43 |
| Paliogen ® Orange | BASF | Orange 51 |
| Irgalite ® Rubine 4BL | Ciba-Geigy | Red 57:1 |
| Quindo ® Magenta | Mobay | Red 122 |
| Indofast ® Brilliant Scarlet | Mobay | Red 123 |
| Hostaperm ® Scarlet GO | Hoechst | Red 168 |
| Permanent Rubine F6B | Hoechst | Red 184 |
| Monastral ® Magenta | Ciba-Geigy | Red 202 |
| Monastral ® Scarlet | Ciba-Geigy | Red 207 |
| Heucophthal ® Blue G KBT 583D | Heubach, Inc. | |
| Heliogen ® Blue L 6901F | BASF | Blue 15:2 |
| Heliogen ® Blue NBD 7010 | BASF | Blue:3 |
| Heliogen ® Blue K 7090 | BASF | Blue 15:3 |
| Heliogen ® Blue L 7101F | BASF | Blue 15:4 |
| Paliogen ® Blue L 6470 | BASF | Blue 60 |
| Heliogen ® Green K 8683 | BASF | Green 7 |
| Heliogen ® Green L 9140 | BASF | Green 36 |

-continued

Pigment List

| Pigment Brand Name | Manufacturer | Color Index Pigment |
|---|---|---|
| Monastral ® Violet R | Ciba-Geigy | Violet 19 |
| Monastral ® Red B | Ciba-Geigy | Violet 19 |
| Quindo ® Red R6700 | Mobay | Violet 19 |
| Quindo ® Red R6713 | Mobay | |
| Indofast ® Violet | Mobay | Violet 23 |
| Monastral ® Violet Maroon B | Ciba-Geigy | Violet 42 |
| Sterling ® NS Black | Cabot | Black 7 |
| Sterling ® NSX 76 | Cabot | |
| Tipure ® R-101 | Du Pont | White 6 |

Other ingredients may be added to the electrostatic liquid developer, such as fine particle size oxides, e.g., silica, alumina, titania, etc.; preferably in the order of 0.5 μm or less can be dispersed into the liquefied resin. These oxides can be used alone or in combination with the colorant. Metal particles can also be added.

Another additional component of the electrostatic liquid developer is an adjuvant which can be selected from the group consisting of polyhydroxy compound which contains at least 2 hydroxy groups, polybutylene succinimide, and aromatic hydrocarbon having a Kauri-butanol value of greater than 30. The adjuvants are generally used in an amount of 1 to 1000 mg/g, preferably 1 to 200 mg/g developer solids. Examples of the various above-described adjuvants include:

polyhydroxy compounds: ethylene glycol, 2,4,7,9-tetramethyl-5-decyn-4,7-diol, poly(propylene glycol), pentaethylene glycol, tripropylene glycol, triethylene glycol, glycerol, pentaerythritol, glycerol-tri-12 hydroxystearate, ethylene glycol monohydroxystearate, propylene glycerol monohydroxy-stearate, etc., as described in Mitchell U.S. Pat. No. 4,734,352;

polybutylene/succinimide: OLOA ®-1200 sold by Chevron Corp., analysis information appears in Kosel U.S. Pat. No. 3,900,412, column 20, lines 5 to 13, incorporated herein by reference; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, and the remainder oil, etc. These adjuvants are described in El-Sayed and Taggi U.S. Pat. No. 4,702,984; and aromatic hydrocarbon: benzene, toluene, naphthalene, substituted benzene and naphthalene compounds, e.g., trimethylbenzene, xylene, dimethylethylbenzene, ethylmethylbenzene, propylbenzene, Aromatic 100 which is a mixture of $C_9$ and $C_{10}$ alkyl-substituted benzenes manufactured by Exxon Corp., etc., as described in Mitchell U.S. Pat. No. 4,631,244.

The disclosures of the above-listed United States patents describing the adjuvants are incorporated herein by reference.

The particles in the electrostatic liquid developer have an average by area particle size of 10 μm or less (Horiba instrument). The average particle size determined by the Malvern 3600E Particle Sizer can vary depending on the use of the liquid developer. The resin particles of the developer may or may not be formed having a plurality of fibers integrally extending therefrom although the formation of fibers extending from the toner particles is preferred. The term "fibers" as used herein means pigmented toner particles formed with fibers, tendrils, tentacles, threadlets, fibrils, ligaments, hairs, bristles, or the like. Illustration of such fibers can be found in Landa et al., U.S. Pat. No. 4,842,974, e.g., the Figures and description in column 17, line 14 to column 18, line 7, the disclosures of which are incorporated herein by reference.

The positively charged electrostatic liquid developer can be prepared by a variety of processes as described in U.S. Pat. No. 4,707,429, issued Nov. 17, 1987. For example, into a suitable mixing or blending vessel, e.g., attritor, heated ball mill, heated vibratory mill such as a Sweco Mill manufactured by Sweco Co., Los Angeles, Calif., equipped with particulate media, for dispersing and grinding, Ross double planetary mixer manufactured by Charles Ross and Son, Hauppauge, N.Y., etc., or a two roll heated mill (no particulate media necessary) are placed at least one of thermoplastic resin, carbohydrate product of photosynthesis comprised of at least one saccharose group, and nonpolar liquid described above. Generally the resin, carbohydrate product, nonpolar liquid and optional colorant are placed in the vessel prior to starting the dispersing step. Optionally the colorant can be added after homogenizing the resin and the nonpolar liquid. Polar additive, similar to that described in Mitchell, U.S. Pat. No. 4,631,244, can also be present in the vessel, e.g., up to 100% based on the weight of polar additive and nonpolar liquid. The dispersing step is generally accomplished at elevated temperature, i.e., the temperature of ingredients in the vessel being sufficient to plasticize and liquefy the resin but being below that at which the nonpolar liquid or polar additive, if present, degrades and the resin and/or colorant decomposes. A preferred temperature range is 80° to 120° C. Other temperatures outside this range may be suitable, however, depending on the particular ingredients used. The presence of the irregularly moving particulate media in the vessel is preferred to prepare the dispersion of toner particles. Other stirring means can be used as well, however, to prepare dispersed toner particles of proper size, configuration and morphology. Useful particulate media are particulate materials, e.g., spherical, cylindrical, etc., selected from the group consisting of stainless steel, carbon steel, alumina, ceramic, zirconia, silica, and sillimanite. Carbon steel particulate media are particularly useful when colorants other than black are used. A typical diameter range for the particulate media is in the range of 0.04 to 0.5 inch (1.0 to approx. 13 mm).

After dispersing the ingredients in the vessel, with or without a polar additive present, until the desired dispersion is achieved, typically 1 hour with the mixture being fluid, the dispersion is cooled, e.g., in the range of 0° C. to 50° C. Cooling may be accomplished, for example, in the same vessel, such as the attritor, while simultaneously grinding with particulate media to prevent the formation of a gel or solid mass; without stirring to form a gel or solid mass, followed by shredding the gel or solid mass and grinding, e.g., by means of particulate media; or with stirring to form a viscous mixture and grinding by means of particulate media. Additional liquid may be added at any step during the preparation of the liquid electrostatic toners to facilitate grinding or to dilute the toner to the appropriate % solids needed for toning. Additional liquid means nonpolar liquid, polar liquid or combinations thereof. Cooling is accomplished by means known to those skilled in the art and is not limited to cooling by circulating cold water or a cooling material through an external cooling jacket adjacent the dispersing apparatus or permitting the dispersion to cool to ambient temperature. The resin precipitates out of the dispersant during the cooling. Toner particles of average particle size (by area) of less than 10 μm, as determined by a Horiba centrifugal particle size analyzer or other comparable apparatus, are formed by grinding for a relatively short period of time.

After cooling and separating the dispersion of toner particles from the particulate media, if present, by means known to those skilled in the art, it is possible to reduce the concentration of the toner particles in the dispersion, impart an electrostatic charge of predetermined polarity to the toner particles, or a combination of these variations. The concentration of the toner particles in the dispersion is reduced by the addition of additional nonpolar liquid as described previously above. The dilution is normally conducted to reduce the concentration of toner particles to between 0.1 to 15 percent by weight, preferably 0.3 to 3.0, and more preferably 0.5 to 2 weight percent with respect to the nonpolar liquid. One or more ionic or zwitterionic charge director compounds (C), of the type set out above, can be added to impart a positive charge. The addition may occur at any time during the process; preferably at the end of the process, e.g., after the particulate media, if used, are removed and the concentration of toner particles is accomplished. If a diluting nonpolar liquid is also added, the charge director compound can be added prior to, concurrently with, or subsequent thereto. If an additional adjuvant compound of a type described above has not been previously added in the preparation of the developer, it can be added prior to or subsequent to the developer being charged. Preferably the adjuvant compound is added after the dispersing step.

Other process embodiments for preparing the electrostatic liquid developer include:

(A) dispersing a thermoplastic resin, carbohydrate product and optionally a colorant and/or adjuvant in the absence of a nonpolar liquid having a Kauri-butanol value of less than 30 to form a solid mass.

(B) shredding the solid mass, (C) grinding the shredded solid mass by means of particulate media in the presence of a liquid selected from the group consisting of a polar liquid having a Kauri-butanol value of at least 30, a nonpolar liquid having a Kauri-butanol value of less than 30, and combinations thereof, (D) separating the dispersion of toner particles having an average by area particle size of less than 10 μm from the particulate media, and (E) adding additional nonpolar liquid, polar liquid or combinations thereof to reduce the concentration of toner particles to between 0.1 to 15.0 percent by weight with respect to the liquid; and (F) adding to the dispersion a nonpolar soluble ionic or zwitterionic charge director compound; and (A) dispersing a thermoplastic resin, carbohydrate product and optionally a colorant and/or adjuvant in the absence of a nonpolar liquid having a Kauri-butanol value of less than 30 to form a solid mass.

(B) shredding the solid mass, (C) redispersing the shredded solid mass at an elevated temperature in a vessel in the presence of a nonpolar liquid having a Kauri-butanol value of less than 30, and optionally a colorant while maintaining the temperature in the vessel at a temperature sufficient to plasticize and liquify the resin and below that at which the nonpolar liquid degrades and the resin and/or colorant decomposes, (D) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particulate media with or without the presence of additional liquid; or (3) while grinding by means of particulate media to prevent the formation of a gel or solid mass with or without the presence of additional liquid;

(E) separating the dispersion of toner particles having an average by area particle size of less than 10 μm from the particulate media, and (F) adding additional nonpolar liquid, polar liquid or combinations thereof to reduce the concentration of toner particles to between 0.1 to 15.0 percent by weight with respect to the liquid; and (G) adding to the dispersion a nonpolar soluble ionic or zwitterionic charge director compound.

INDUSTRIAL APPLICABILITY

The positive charged liquid electrostatic developers of this invention demonstrate improved image quality, resolution, solid area coverage (density), and toning of fine details, evenness of toning, and reduced squash independent of charge director or pigment present. The particles are exclusively charged positive. The developers of the invention are useful in copying, e.g., making office copies of black and white as well as various colors; or color proofing, e.g., a reproduction of an image using the standard colors: yellow, cyan, magenta together with black as desired; highlight color copying, e.g., copying of two colors, usually black and a highlight color for letterheads, underlining, etc. In copying and proofing the toner particles are applied to a latent electrostatic image and can be transferred, if desired. Other uses envisioned for the positive liquid electrostatic developers include: digital color proofing, lithographic printing plates, and resists.

EXAMPLES

The following controls and examples wherein the parts and percentages are by weight illustrate but do not limit the invention. In the examples the melt indices are determined by ASTM D 1238, Procedure A; and the average particle sizes by area were determined by a Malvern 3600 Particle Sizer, or the Horiba CAPA 500 centrifugal particle analyzer.

Image quality of the developers of the invention was determined on a modified Savin 870 copier unless specifically noted. This device consists of a Savin 870 copier with the modifications described below.

Mechanical modifications include addition of a pretransfer corona and removing the anodized layer from the surface of the reverse roll while decreasing the diameter of the roll spacers to maintain the same gap between the roll and photoconductor.

Electrical modifications include:

(1) disconnecting the image density feedback loop from the development electrode and connecting the electrode to a Keithly high voltage supply (model 247) (Keithly, Cleveland, Ohio), (2) connecting a Keithly high voltage supply (model 247) to the modified reverse roll, and (3) disconnecting the transfer corona and connecting same to a Trek (model 610) high voltage supply (Trek, Medina, N.Y.).

The modified Savin 870 was then used to evaluate both positive and negative developers depending on the voltages and biasses used. To evaluate positive developers the copier was run in a positive mode: reversed image target was used with negative transfer corona voltages and positive development bias. The reversed image target consists of white characters and lines, etc., on a black background.

The principal of operation is described below. The photoconductor is charged positive (near 1000V) by means of the charging corona. The copy is imaged onto the photoconductor inducing the latter to discharge to lower voltages (in order of increasing discharge-black areas and white areas). When adjacent to the toner electrode the photoconductor has fields at its surface such that positively charged toner will deposit at the white imaged areas, negatively charged toner at the black imaged areas. If necessary toner background is removed by the biased reverse roll. The toner is then transferred to paper by the transfer corona (the transfer force due to the negative charge sprayed on the back of the paper). The toner is then thermally fused. Actual voltages and biases used can be found in the examples.

CONTROL 1

A black developer was prepared by adding 340 g of a Elvacite® 2014, a methacrylate copolymer (E. I. du Pont de Nemours and Co., Wilmington Del.), 85 grams of Uhlich® BK 8200 (Paul Uhlich & Co., Hasting-On-Hudson, N.Y.) and 863 grams of Isopar®-L to a Union Process IS Attritor, Union Process Company, Akron, Ohio charged with 0.1875 inch (4.76 mm) diameter carbon steel balls. The mixture was milled at 100° C. to 105° C. for 1 hour, then cooled to ambient temperature and then milled for 6 hours. The particle size was 7.4 μm measured with a Malvern particle size analyzer. The developer was diluted and charged as follows: 1500 grams of 1% solids was charged with 9.0 grams of 10% Basic Barium Petronate® (Witco Corp., New York, N.Y.) to the 60 mg/g level. Image quality was determined using the Savin 870 copier with Offset paper manufactured by Plainwell Paper Co., Plainwell, Mich. and Savin 2200 paper, under positive toner test conditions: charging corona set at +6.8 Kv, Development Bias set at +650 volts, and transfer corona set at −6.6 Kv, Reversal Image Target (black areas on target image with negative toner, white areas on target image with positive toner, gray areas are background). Results are found in Table 1.

A black developer was prepared by adding 298 g of a Elvacite® 2014, a methacrylate copolymer (E. I. du Pont de Nemours and Co., Wilmington, Del.), 85 grams of Uhlich® BK 8200 (Paul Uhlich & Co., Hasting-On-Hudson, N.Y.), 42.5 grams alpha-D-glucose, anhydrous (Aldrich Chemical Co., Milwaukee, Wis.) and 863 grams of Isopar®-L to a Union Process 1S Attritor, Union Process Company, Akron, Ohio charged with 0.1875 inch (4.76 mm) diameter carbon steel balls. The mixture was milled at 100° C. for 1 hour, then cooled to ambient temperature and then milled for 5 hours. The particle size was 6.7 μm measured with a Malvern particle size analyzer. The developer was diluted and charged as follows: 1500 grams of 1% solids were charged with 9.0 grams of 10% Basic Barium Petronate® (Witco Corp., New York, N.Y.) to the 60 mg/g level. Image quality was determined using the Savin 870 copier with Offset and Savin paper described in Control 1 under positive toner test conditions: charging corona set at +6.8 Kv, Development Bias set at +650 volts, and transfer corona set at −6.6 Kv, Reversal Image Target (black areas on target image with negative toner, white areas on target image with positive toner, gray areas are background). Results are shown in Table 1 below.

EXAMPLE 2

A black developer was prepared as described in Example 1 except that D-ribose 99% (Aldrich Chemical Corp., Milwaukee, Wis.) was used rather than glucose. The particle size was 5.0 μm measured with a Malvern particle size analyzer. Results are shown in Table 1 below.

EXAMPLE 3

A black developer was prepared as described in Example 1 except that D-fructose 98% (Aldrich Chemical Corp., Milwaukee, Wis.) was used rather than glucose. The particle size was 7.6 μm measured with a Malvern particle size analyzer. Results are shown in Table 1 below.

TABLE 1

| ADDITIVE | COND. (pmhos/cm) | PAPER | DENSITY | RES (LP/MM) | TRANSFER EFF. (%) |
|---|---|---|---|---|---|
| NONE | 21 | Savin | 0.41 | 2 | 45 |
| Control 1 | | Offset | 0.49 | 3 | 59 |
| D-glucose | 17 | Savin | 0.46 | 4 | 48 |
| Example 1 | | Offset | 0.62 | 3 | 61 |
| D-ribose | 22 | Savin | 0.79 | 4 | 46 |
| Example 2 | | Offset | 0.92 | 9 | 61 |
| D-fructose | 19 | Savin | 0.45 | 2 | 44 |
| Example 3 | | Offset | 0.59 | 3 | 61 |

CONTROL 2

A black developer was prepared as described in Control 1 with the following exception: the developer was charged with 13.5 g of 10% EMPHOS® D70-30C. (Witco Corp., New York, N.Y.) to the 90 mg/g level. Results are shown in Table 2 below.

EXAMPLE 4

Black developers were prepared as described in Example 1, 2 and 3 (Samples 1, 2 and 3) with the following exception: the developers were charged with 13.5 g of 10% EMPHOS® D70-30C. (Witco Corp., New York, N.Y.) to the 90 mg/g level. Results are shown in Table 2 below.

EXAMPLE 5

A black developer (Sample 4) was prepared as described in Control 1 with the following exception: the developer was charged with 13.5 g of 10% EMPHOS® D70-30C. (Witco Corp., New York, N.Y.) containing 1% D-ribose 99% (Aldrich Chemical Corp., Milwaukee, Wis.) to the 90 mg/g level. Results are shown in Table 2 below.

TABLE 2

| ADDITIVE | COND. (pmhos/cm) | PAPER | DENSITY | RES (LP/MM) | TRANSFER EFF. (%) |
|---|---|---|---|---|---|
| NONE | 20 | Savin | 0.65 | 3 | 51 |
| Control 2 | | Offset | 0.84 | 5 | 72 |

TABLE 2-continued

| ADDITIVE | COND. (pmhos/cm) | PAPER | DENSITY | RES (LP/MM) | TRANSFER EFF. (%) |
|---|---|---|---|---|---|
| D-glucose | 18 | Savin | 0.63 | 5 | 56 |
| Sample 1 | | Offset | 0.91 | 4 | 78 |
| D-ribose | 23 | Savin | 0.80 | 10 | 64 |
| Sample 2 | | Offset | 1.41 | 7.5 | 100 |
| D-fructose | 17 | Savin | 0.75 | 3 | 54 |
| Sample 3 | | Offset | 1.33 | 5 | 100 |
| D-ribose | 24 | Savin | 0.73 | 6 | 54 |
| Sample 4 | | Offset | 1.25 | 6 | 100 |

CONTROL 3

A cyan developer was prepared by adding 337.5 g of a copolymer of ethylene (90%) and methacrylic acid (10%), melt index at 190° C. is 500, acid no. is 60, 37.7 grams of Heucophthal® Blue G XBT 583D pigment (Heubach, Inc., Newark, N.J.) and 761 grams of Isopar®-L to a Union Process 1S Attritor, Union Process Company, Akron, Ohio charged with 0.1875 inch (4.76 mm) diameter carbon steel balls. The mixture was milled at 100° C. for 1 hour then cooled to ambient temperature and then milled for 6 hours The particle size was 9.0 μm measured with a Malvern particle size analyzer. The developer was diluted and charged as follows: 1500 grams of 1% solids were charged with 12.0 g of 10% EMPHOS® D70-30C. (Witco Corp., New York, N.Y.) to the 75 mg/g level. Image quality was determined using the Savin 870 copier with Offset paper manufactured by Plainwell Paper Co., Plainwell, Mich. and Savin paper described in Control 1 under positive toner test conditions: charging corona set at +6.8 Kv, Development Bias set at +650 volts, and transfer corona set at −6.6 Kv, Reversal Image Target (black areas on target image with negative toner, white areas on target image with positive toner, gray areas are background). Results are shown in Table 3 below.

EXAMPLE 6

A cyan developer was prepared by adding 262.5 g of a copolymer of ethylene (90%) and methacrylic acid (10%), melt index at 190° C. is 500, acid no. is 60, 37.7 grams of Heucophthal® Blue G XBT 583D pigment, and 75 grams of L-sorbose (Aldrich Chemical Co., Milwaukee, Wis.) and 761 grams of Isopar®-L to a Union Process 1S Attritor, Union Process Company, Akron, Ohio charged with 0.1875 inch (4.76 mm) diameter carbon steel balls. The mixture was milled at 100° C. for 1 hour, cooled to ambient temperature and then milled for 6.5 hours. The particle size was 8.2 μm measured with a Malvern particle size analyzer. The developer was diluted and charged as follows: 1500 grams of 1% solids were charged with 12.0 g of 10% EMPHOS® D70-30C. (Witco Corp., New York, N.Y.) to the 75 mg/g level (Sample 5).

A cyan developer (Sample 6) was prepared as described above except that D-galactose 97% (Aldrich Chemical Corp., Milwaukee, Wis.) was used instead of L-Sorbose The particle size was 7.3 μm measured with a Malvern particle size analyzer.

Image quality was determined using the Savin 870 copier with Offset and Savin paper described in Control 1 under positive toner test conditions: charging corona set at +6.8 Kv, Development Bias set at +650 volts, and transfer corona set at −6.6 Kv, Reversal Image Target (black areas on target image with negative toner, white areas on target image with positive toner, gray areas are background). Results are found in Table 3 below.

TABLE 3

| ADDITIVE | COND. (pmhos/cm) | PAPER | DENSITY | RES (LP/MM) | TRANSFER EFF. (%) |
|---|---|---|---|---|---|
| NONE | 16 | Savin | 0.21 | 3 | 85 |
| Control 3 | | Offset | 0.13 | 2 | 50 |
| L-sorbose | 23 | Savin | 0.36 | 4 | 82 |
| Sample 5 | | Offset | 0.20 | 5 | 60 |
| D-galactose | 15 | Savin | 0.42 | 4 | 85 |

CONTROL 4

A developer is prepared without pigment by adding 340 g of a Elvacite ® 2014, a methacrylate copolymer (E. I. du Pont de Nemours and Co., Wilmington, Del.), and 863 grams of Isopar ®-L to a Union Process 1S Attritor, Union Process Company, Akron, Ohio charged with 0.1875 inch (4.76 mm) diameter carbon steel balls. The mixture is milled at 100° C. to 105° C. for 1 hour then cooled to ambient temperature and then milled for 6 hours. The developer is diluted and charged as follows: 1500 grams of 1% solids are charged with 9.0 grams of 10% Basic Barium Petronate ® (Witco Corp., New York, N.Y.) to the 60 mg/g level. Image quality is determined using Savin 870 with Offset paper under positive toner test conditions: charging corona set at +6.8 Kv, Development Bias set a 650 volts, and transfer corona set at −6.6 Kv, Reversal Image Target (black areas on target image with negative toner, white areas on target image with positive toner, gray areas are background).

EXAMPLE 7

A developer is prepared without pigment by adding 298 g of Elvacite ® 2014, a methacrylate copolymer (E. I. du Pont de Nemours and Co., Wilmington, Del.), and 42.5 grams alpha-D-glucose, anhydrous (Aldrich Chemical Co., Milwaukee, WI) and 863 grams of Isopar ®-L to a Union Process 1S Attritor, Union Process Company, Akron, Ohio charged with 0.1875 inch (4.76 mm) diameter carbon steel balls. The mixture is milled at 100° C. for 1 hour then cooled to ambient temperature and then milled for 5 hours. The developer is diluted and charged as follows: 1500 grams of 1% solids are charged with 9.0 grams of 10% Basic Barium Petronate ®(Witco Corp., New York, N.Y.) to the 60 mg/g level. Image quality is determined as in control above. Image quality for example is found to be better than that of control for resolution and transfer efficiency.

We claim:

1. An electrostatic liquid developer having positive charging characteristics consisting essentially of (A) a nonpolar liquid having a Kauri-butanol value of less than 30, present in a major amount, (B) thermoplastic resin particles having an average by area particle size of less than 10 μm, (C) a nonpolar liquid soluble ionic or zwitterionic charge director compound, and (D) a carbohydrate product of photosynthesis comprised of at least one saccharose.

2. An electrostatic liquid developer having positive charging characteristics consisting essentially of (A) a nonpolar liquid having a Kauri-butanol value of less than 30, present in a major amount (B) thermoplastic resin particles having an average by area particle size of less than 10 μm (C) a nonpolar liquid soluble ionic or zwitterionic charge director compound, and (D) a carbohydrate product of photosynthesis comprised of at least one saccharose, the carbohydrate product of photosynthesis is selected from the group consisting of D-glucose, D-ribose, D-fructose, D-allose, A-altrose, D-mannose, D-sorbose, D-gulose, D-idose, D-galactose, D-talose, D-psicose, D-tagatose, L-gulose, L-sorbose, and L-glucose.

3. An electrostatic liquid developer according to claim 2 wherein the carbohydrate product of photosynthesis is D-glucose.

4. An electrostatic liquid developer according to claim 2 wherein the carbohydrate product of photosynthesis is D-ribose.

5. An electrostatic liquid developer according to claim 2 wherein the carbohydrate product of photosynthesis is D-fructose.

6. An electrostatic liquid developer according to claim 2 wherein the carbohydrate product of photosynthesis is L-sorbose.

7. An electrostatic liquid developer according to claim 2 wherein the carbohydrate product of photosynthesis is D-galactose.

8. An electrostatic liquid developer according to claim 2 wherein component (A) is present in 85 to 99.9% by weight, based on the total weight of the liquid developer, the total weight of developer solids is 0.1 to 15% by weight, component (C) is present in an amount of 0.25 to 1,500 mg/g developer solids, and the carbohydrate product of photosynthesis (D) is present in an amount of 1 to 25% based on the total weight of developer solids.

9. An electrostatic liquid developer according to claim 8 wherein the carbohydrate product of photosynthesis is present in an amount of 5 to 15% based on the total weight of developer solids.

10. An electrostatic liquid developer according to claim 2 containing up to about 60% by weight of a colorant based on the total weight of developer solids.

11. An electrostatic liquid developer according to claim 10 wherein the colorant is a pigment.

12. An electrostatic liquid developer according to claim 10 wherein the colorant is a dye.

13. An electrostatic liquid developer according to claim 2 wherein a fine particle size oxide is present.

14. An electrostatic liquid developer according to claim 2 wherein an additional compound is present which is an adjuvant selected from the group consisting of polyhydroxy compounds, polybutylene succinimide, and an aromatic hydrocarbon.

15. An electrostatic liquid developer according to claim 10 wherein an additional compound is present which is an adjuvant selected from the group consisting of polyhydroxy compounds, polybutylene succinimide, and an aromatic hydrocarbon.

16. An electrostatic liquid developer according to claim 14 wherein a polyhydroxy adjuvant compound is present.

17. An electrostatic liquid developer according to claim 14 wherein a polybutylene succinimide adjuvant compound is present.

18. An electrostatic liquid developer according to claim 14 wherein an aromatic hydrocarbon adjuvant compound having a Kauri-butanol value of greater than 30 is present.

19. An electrostatic liquid developer according to claim 2 wherein the thermoplastic resin component (B) is a copolymer of at least one alkyl ester of acrylic or methacrylic acid wherein alkyl is 1 to 20 carbon atoms and acrylic or methacrylic acid.

20. An electrostatic liquid developer according to claim 2 wherein the thermoplastic resin component is a copolymer of methyl methacrylate (50–90%)/methacrylic acid (0–20%)/ethylhexyl acrylate (10–50%).

21. An electrostatic liquid developer according to claim 20 wherein the thermoplastic resin component is a copolymer of methyl methacrylate (67%)/methacrylic acid (3%)/ethylhexyl acrylate (30%).

22. An electrostatic liquid developer according to claim 2 wherein the thermoplastic resin component is a copolymer of ethylene (90%)/methacrylic acid (10%) having a melt index at 190° C. of 500.

23. An electrostatic liquid developer according to claim 2 wherein the particles have an average particle size by area of less than 5 μm.

24. An electrostatic liquid developer according to claim 2 wherein component (C) is a salt of phosphated mono- and diglycerides with unsaturated or saturated acid substituents.

25. An electrostatic liquid developer according to claim 2 wherein component (C) is an oil-soluble petroleum sulfonate.

26. An electrostatic liquid developer according to claim 2 wherein component (C) is a metallic soap.

27. An electrostatic liquid developer according to claim 2 wherein the resin particles have a plurality of fibers integrally extending therefrom.

28. An electrostatic liquid developer according to claim 2 wherein component (D) is present dispersed in resin particles (B).

* * * * *